US005445277A

United States Patent [19]

Takemoto et al.

[11] Patent Number: 5,445,277

[45] Date of Patent: Aug. 29, 1995

[54] PAPER STRIP CONVEYING AND STACKING APPARATUS

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 178,292

[22] PCT Filed: Jul. 10, 1992

[86] PCT No.: PCT/JP92/00887

§ 371 Date: Jan. 11, 1994

§ 102(e) Date: Jan. 11, 1994

[87] PCT Pub. No.: WO93/01117

PCT Pub. Date: Jan. 21, 1993

[30] Foreign Application Priority Data

Jul. 11, 1991 [JP] Japan ..... 3-170949

[51] Int. Cl.[6] ..... B07C 5/00

[52] U.S. Cl. ..... 209/534; 271/298; 271/303; 271/186

[58] Field of Search ..... 209/534, 552; 271/3, 271/4, 6, 7, 298, 303, 65, 185, 186

[56] References Cited

U.S. PATENT DOCUMENTS 3,866,904 2/1975 Stemmle ..... 271/65 X
4,830,742 5/1989 Takesako ..... 209/534
4,928,230 5/1990 Kawamura et al. ..... 209/534 X

FOREIGN PATENT DOCUMENTS 50-130497 10/1975 Japan .
54-113399 9/1979 Japan .
59-174988 10/1984 Japan .
61-94964 5/1986 Japan .
62-79143 4/1987 Japan .
62-111862 5/1987 Japan .
63-73261 5/1988 Japan .
63-139826 11/1988 Japan .
2140186A 11/1984 United Kingdom .

*Primary Examiner*—David H. Bollinger
*Attorney, Agent, or Firm*—Lowe, Price, Leblanc & Becker

[57] ABSTRACT

A paper strip conveying and stacking apparatus including a receiving unit for receiving loaded paper strips and for discharging them, a conveying unit for conveying the paper strips discharged from said receiving unit and a stacking unit for sorting and stacking the conveyed paper strips is characterized in that said conveying unit includes a main conveying unit having a normal passage through which paper strips pass with given sides facing upwards and reach one end side of said stacking unit and a subsidiary conveying unit having a reversing passage for passing the paper strips introduced from said normal passage around the outer periphery of said stacking unit and for conveying them to the other end side of said stacking unit after reversing the upward facing sides of the paper strips, a device for detecting the faces of the paper strip being provided at a position along the length of said normal passage, and a passage switching mechanism for introducing the paper strips passing through the normal passage to said reversing passage in response to a signal from said face detecting device, said stacking unit being provided with main and subsidiary entrances on one and the other end sides, respectively, the exits of said normal and reversing passages being disposed so that they face the main and subsidiary entrances, respectively.

15 Claims, 2 Drawing Sheets

PAPER STRIP CONVEYING AND STACKING APPARATUS

TECHNICAL FIELD

The present invention relates to a paper strip conveying and stacking apparatus including a receiving unit for receiving loaded paper strips and for discharging them, a conveying unit for conveying the paper strips discharged from said receiving unit and a stacking unit for sorting and stacking the conveyed paper strips.

BACKGROUND TECHNOLOGY

Such a type of prior art paper strip conveying and stacking apparatus is disclosed in, for example, Japanese Unexamined Patent Publication (KOKAI) No. Sho 62-111862.

That is, paper strips which are inserted into a receiving unit of a pin ball renting machine are fed to a conveying machine by means of feeding pulleys and pressing pulleys, and then conveyed to a stacking unit (magazine) via a loading means. Although paper strips which become jammed during conveying can be removed, some of the paper strips are stacked with their face sides up and other paper strips are stacked with their reverse sides up in the stacking unit.

However, such a type of prior art paper strip conveying and stacking apparatus is provided in a money exchanging machine or the like, and the paper strips with the faces up are despatched from the stacking unit to a dispensing portion of the money exchanging machine. Therefore, users of the money exchanger who are expecting paper strips which should all be the same may think that they include different paper strips and the paper strips having the faces up are inconvenient for users who desire to put the paper strips into their purses all facing the same way.

The present invention was made in view of above mentioned problems of the prior art.

It is an object of the present invention to provide a paper strip conveying and stacking apparatus having a simple structure which is capable of sorting and stacking the paper strips with only either sides up which are delivered from the conveying unit.

DISCLOSURE OF THE INVENTION

In accordance with the present invention, there is provided a paper strip conveying and stacking apparatus including a receiving unit for receiving loaded paper strips and for discharging them, a conveying unit for conveying the paper strips discharged from said receiving unit and a stacking unit for sorting and stacking the conveyed paper strips characterized in that said conveying unit includes a main conveying unit having a normal passage through which paper strips pass with given sides up and reach one end side of said stacking unit and a subsidiary conveying unit having a reversing passage for passing the paper strips introduced from said normal passage around the outer periphery of said stacking unit and for conveying them to the other end side of said stacking unit after reversing the upward facing sides of the paper strips, means for detecting the faces of the paper strip being provided in a position along the length of said normal passage, and a passage switching means for introducing the paper strips passing through the normal passage to said reversing passage in response to a signal from said face detecting means, said stacking unit being provided with main and subsidiary entrances on one and the other end sides, respectively, the exits of said normal and reversing passages being disposed so that they face the main and subsidiary entrances, respectively.

In accordance with the present invention there is further provided a paper strip conveying and stacking apparatus including a receiving unit for receiving loaded paper strips and for discharging them, a conveying unit for conveying the paper strips discharged from said receiving unit and a stacking unit for sorting and stacking the conveyed paper strips characterized in that said stacking unit includes a plurality of sorting stackers which are arranged in a vertical direction for sorting the paper strips and stacking the sorted paper strips, each of said sorting stackers being provided with main and subsidiary entrances on one and the other end sides respectively, said conveying unit including main and subsidiary conveying units which are provided on one and the other end sides respectively of said stacking unit, said main conveying unit having a normal passage through which various sorts of the paper strips are passed without reversing their upward facing sides, said subsidiary conveying unit having a reversing passage through which the paper strips introduced from the final end of said normal passage are turned around the outer periphery of the sorting stacker which is located in the uppermost or lowermost position of said stacking unit to reverse the upward facing sides of the paper strips, said normal passage being provided with means for detecting the faces of the paper strips, means for identifying the sort of the paper strips and deflecting means for introducing each strip to the main entrance of a relevant sorting stacker in response to signals from said face detecting means and said sort detecting means disposed along the length of said normal passage, said normal passage being provided with a passage switching means for introducing paper strips passing through the normal passage in response to the signal from said face detecting means at the final end thereof; said reversing passage being provided in a position along the length thereof with deflecting means for introducing each paper strip to the subsidiary entrance of each sorting stacker in response to the signal from said sort detecting means.

Said apparatus, preferably, has a separating mechanism for individually separating the paper strips discharged from said receiving unit and for conveying the paper strips.

Further, said normal passage is preferably provided with counting means for outputting the number of paper strips which pass through said normal passage in a position along the length thereof.

The paper strips which are conveyed to the receiving unit in the paper strip conveying and stacking apparatus from the paper strip conveyer are transferred to the stacking unit by the conveying unit after they are individually separated by means of the separating mechanism, if one is provided.

When the paper strips are passed through the normal passage of the main conveying unit, identification of whether the paper strip have the face sides up or not is made by the face, the face detecting means, detecting means provided along the length of the normal passage.

If it is identified that the paper strip passes with the face side up, it is conveyed with the face side up along the normal passage of the main conveying unit to reach one end side of the stacking unit. The paper strips which are conveyed in such a manner are conveyed into the stacking unit from the main entrance provided on one end side of the stacking unit.

On the other hand, if it is identified by the face or reverse side detecting means that the paper strip passes along the normal passage with the reverse side up, the passage switching means is actuated in response to the signal from the face detecting means for introducing the paper strips passing through the normal passage into the reversing passage of the subsidiary conveying unit.

The paper strips which are introduced to the reversing passage of the subsidiary conveying unit from the normal passage of the main conveying unit are delivered around the outer periphery of the stacking unit to the other end side of the stacking unit. The paper strips, the sides of which are reversed are conveyed into the stacking unit from the subsidiary entrance provided on the other end side of the stacking unit with the face sides up.

In such a manner, the paper strips which are determined as having their face sides up are conveyed into the stacking unit by the main conveying unit without reversing their sides while the paper strips which are determined as having their reverse sides up are conveyed to the stacking unit after reversing of their upward facing sides by the subsidiary conveying unit. This causes the paper strips to be sorted and stacked with all the face sides up.

In the case where the stacking unit has a plurality of sorting stackers which sort and stack the same sorts of paper strips in a vertical direction, the paper strips of each sort can be stacked with the face sides up in the sorting and stacking unit corresponding to the sort by means of the sort detecting means, for identifying the sort of the paper strip, positioned in the normal passage of the main conveying unit.

BEST MODE FOR EMBODYING THE INVENTION

Now, an embodiment of the present invention will be described with reference to the drawings.

Figure 1:
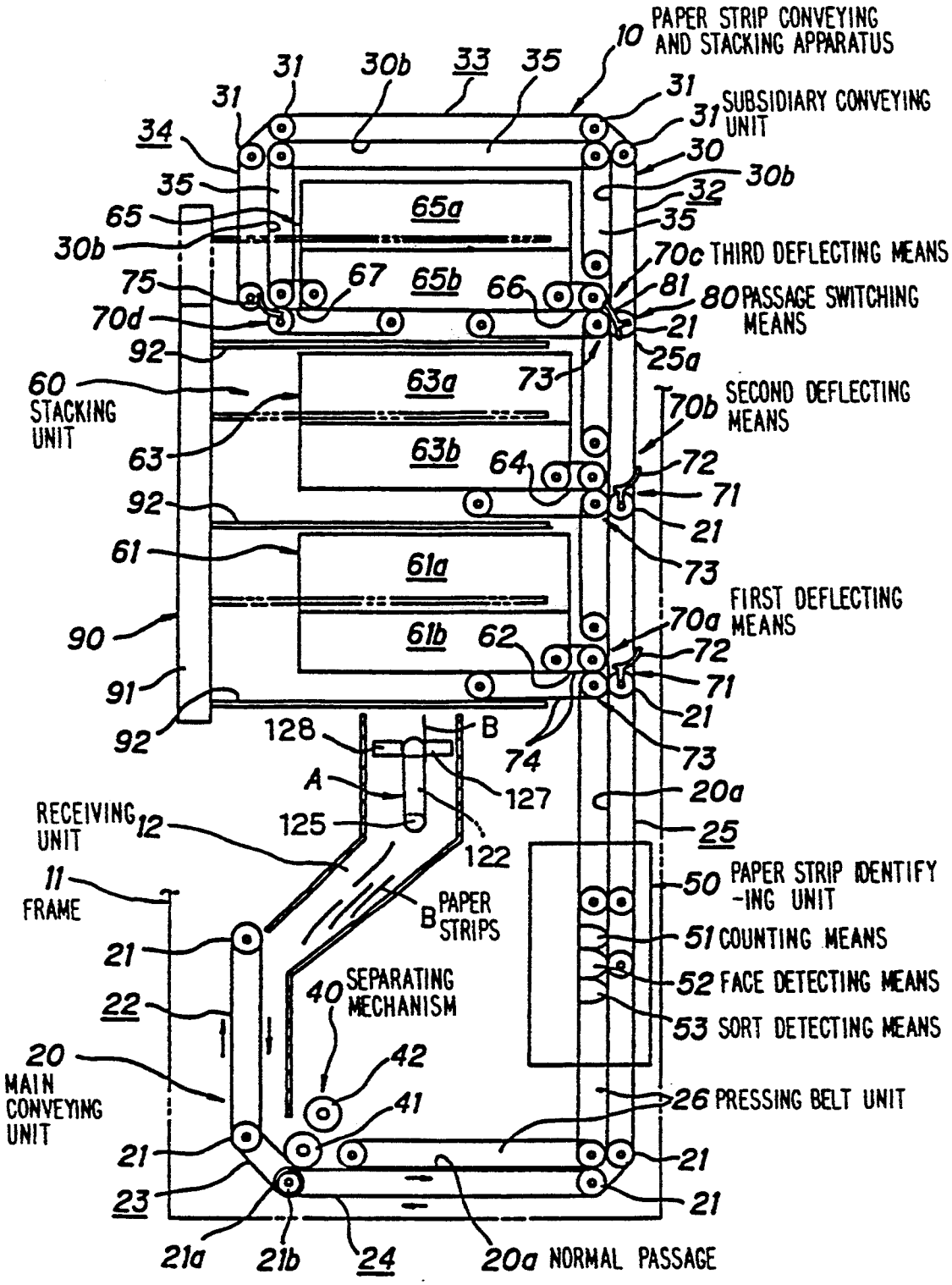
FIG. 1 is a front view showing an embodiment of a paper strip conveying and stacking apparatus of the present invention.

FIG. 1 shows an embodiment of the present invention.

As shown in FIG. 1, a paper strip conveying and stacking apparatus 10 has, within a frame 11, a receiving unit 12 into which strips of paper B conveyed from a conveyor A are inserted, a separating mechanism 40 for individually separating paper strips B and conveying units 20 and 30 for conveying each of the paper strips B to a stacking unit 60.

Figure 2:
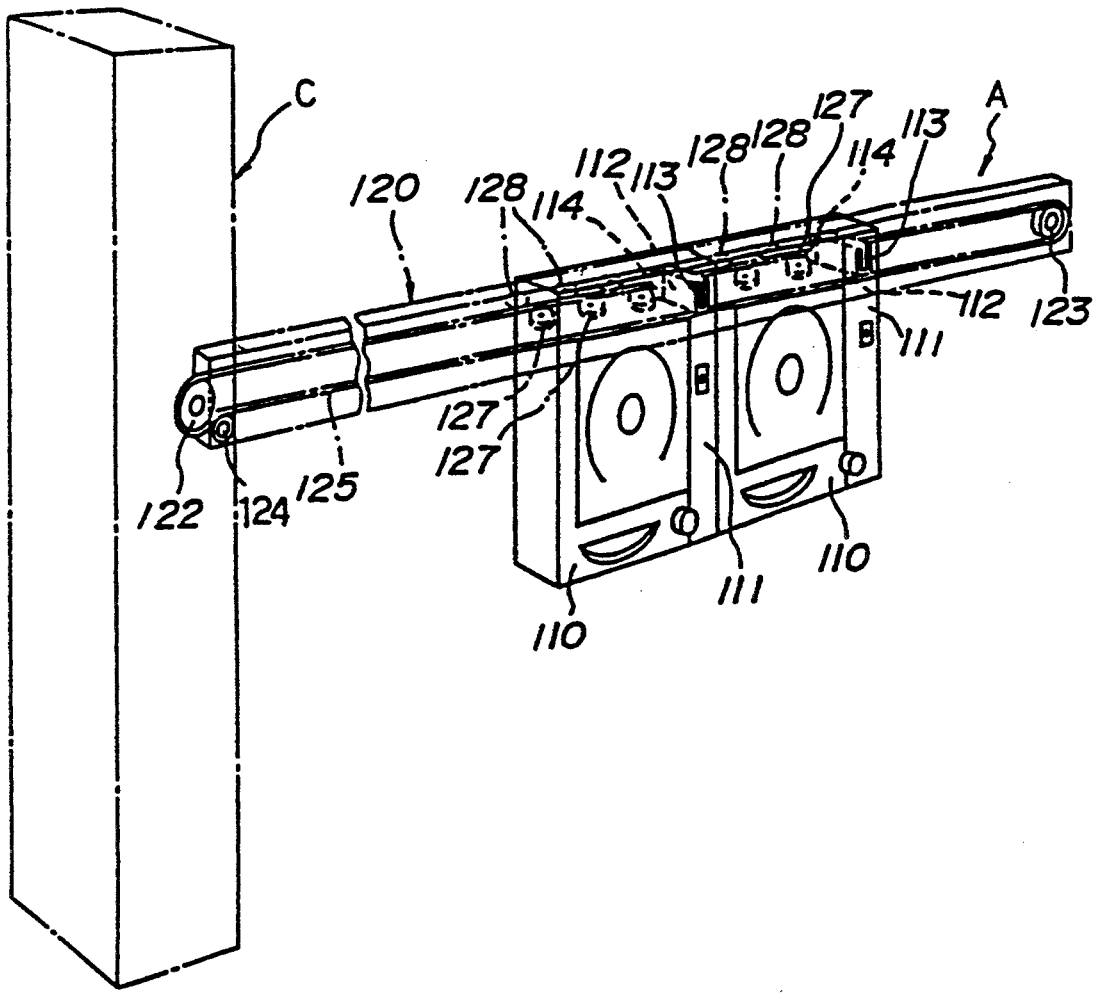
FIG. 2 is an explanatory view of a paper strip conveying system using the paper strip conveying and stacking apparatus of the present invention.

The conveying machine A is provided across game playing machines 110 and paper money identifying machines 110 each disposed between the machines 110, which serve as paper strip handling machines as shown in FIG. 2. A charge receiving box C is disposed at one end of a charge collecting line 120 which collects and feeds charges. Paper money which is paid as charges is conveyed along a charge collecting line 120 from the paper money identifying machines 111 to the charge receiving box C. The paper money identifying machine 111 includes a paper examining unit 112 having a paper money insertion opening slot 113 and an ejecting slot 114 which open at upper and rear portions thereof, respectively.

An endless belt 125 having a round cross-section is tensioned between a driving pulley 122 and a driven pulley 123 which are provided at opposite ends of the charge collecting line 120. Pairs of pressing pulleys 127 and 128 which sandwich the round belt 125 from the opposite sides thereof are continuously provided along the length of the belt 125 between the pulleys 122 and 123. A pinch pulley 124 is disposed at the end of the line close to the driving pulley 122 for positively driving the round belt 125 by increasing the friction between the driving pulley 122 and the round belt 125 even if the round belt 125 is stretched.

The paper strip conveying and stacking apparatus 10 of the present invention is provided in the charge receiving box C. The conveying unit comprises a main conveying unit 20 and a subsidiary conveying unit 30. The main conveying unit 20 has a normal passage **20*a* through which paper strips with either side up discharged from the receiving unit 12 pass and reach one end of the stacking unit 60. A paper identifying unit 50 is provided at a position along the length of the normal passage 20*a*. The normal passage 20*a* is provided with a passage switching means 80** at a final terminal thereof.

The subsidiary conveying unit 30 has a reversing passage **30*b* in which paper strips introduced from the final terminal of the normal passage 20*a* pass around the outer periphery of the uppermost portion of the stacking unit 60 so as to reverse their upward facing sides and arrive at the opposite end side of the stacking unit 60**.

Specifically, the main conveying unit 20 firstly descends downward from the receiving unit 12 once and ascends vertically along the side wall of the frame 11 of the charge collecting box C and reaches the stacking unit 60. The main conveying unit 20 includes a plurality of pulleys 21, an introducing belt 22 tensioned between the pulleys 21, a paper strip one by one conveying belt 23, horizontal and vertical belts 24 and 25 and pressing belt units 26 for pressing the horizontal and vertical belts 24 and 25.

Spaces between the horizontal and vertical belts 24, 25 and pressing belt units 26 provide normal passages **20*a*. A separating mechanism 40 is provided in the vicinity of the one by one conveying belt 23**.

The separating mechanism 40 is arranged to individually separate the strips of paper conveyed from the introducing belt 22 and to convey them to the horizontal belt 24 one by one. Specifically, the separating mechanism 40 comprises, as shown in FIG. 1, a friction roller 41 which is provided so that it can be in contact with or separated from the one by one conveying belt 23 and a reversing roller 42 which is brought into contact with the frictional roller 41 when necessary, to impart a rotational torque thereto.

A feeding roller **21*b* is coaxially coupled with the pulley 21*a* around which the one by one conveying belt 23 is tensioned and which is located on the side of the horizontal belt 24. The feeding roller 21*b*** is provided so that it is driven via a clutch mechanism and the like by an electric motor (not shown).

A very small spacing is provided between the friction roller 41 and reversing roller 42. The spacing is preset so that it is thicker than the thickness of one paper strip but is thinner than the thickness of two paper strips. The friction roller 41 is biased toward the feeding roller **21*b***.

The pressing belt unit 26 is disposed along the horizontal belt 24. The pressing belt of the pressing belt unit 26 is close to the horizontal belt 24. A spacing between the pressing belt and the horizontal belt 24 provides a normal passage 20*a* through which paper strips are passed.

The paper strip identifying unit 50 is provided substantially in the center of the lower half portion of the vertical belt 25. The paper strip identifying unit 50 has a face detecting means 52 for identifying the face of a 1000 yen bank note, sort detecting means 53 for identifying the sort of the paper strip and a counting means 51 for outputting the number of paper strips which have passed through the normal passage 20*a*. The face detecting means 52 may identify the faces of paper money by utilizing, for example, pattern recognition technology. Each of the detecting means comprises a magnetic head sensor or optical sensor for outputting signals. These sensors may be used individually or in common.

The stacking unit 60 is provided in parallel with and along the upper half portion of the vertical belt 25. The stacking unit 60 comprises a lowermost first sorting stacker 61 for 10000 yen bank notes; an intermediate second sorting stacker 63 for 5000 yen bank notes; and an uppermost third sorting stacker 65 for 1000 yen bank notes. Each of the sorting stackers 61, 63 and 65 is divided into upper bins 61*a*, 63*a* and 65*a* and lower bins 61*b*, 63*b* and 65*b*.

The lower bins 61*b*, 63*b* and 65*b* of the first, second and third sorting stackers 61, 63 and 65 are provided with main entrances 62, 64 and 66, respectively on one end sides thereof which are close to the vertical belt 25.

First, second and third deflecting means 70*a*, 70*b* and 70*c* for introducing each paper strip to relevant main entrances 62, 64 and 66 of the stacking unit 61 in response to a signal from the paper strip identifying unit 50 are provided along the normal passage 20*a* close to the vertical belt 25 so that they face the main entrances 62, 64 and 66 of the stacking unit 60.

Each of the deflecting means 70*a* and 70*b* comprises a guide mechanism 71 for introducing the paper strips passing through the normal passage 20*a* into the main entrances 62 and 64 of the stacking unit 60 in response to a given signal from the paper identifying unit 50, and loading mechanism 73 for loading paper strips introduced by the mechanism 71 from the main entrances 62 and 64 into the lower bins 61*b* and 63*b* of the sorting stacking units 61 and 63, respectively.

Each of the guide mechanisms 71 has a curved guide plate 72 which is swingably pivoted to the pulley 21 for changing the moving direction of the paper strips. For example, the guide plate 72 of the guide mechanism 71 for the first deflecting means 70*a* is arranged to swing counterclockwise by 90 degrees from the illustrated erected position when it receives a signal identifying "10000 yen bank note" from the sort detecting means 53.

Each of the loading mechanisms 73 comprises a plurality of pulleys and loading belts 74 which are tensioned between the pulleys as shown in the drawing, and is arranged to load into relevant sorting stackers 61 and 63, through the main entrances 62 and 64, paper strips which are introduced from the normal passage 20*a* by the guide mechanism 71 which is actuated in response to a signal from the paper strip identifying unit 50.

The third deflecting means 70*c* comprises a passage switching means 80, which is provided in lieu of the guide mechanism 71, in the vicinity of the upper end 25*a* of the vertical belt 25 which is the final terminal of the normal passage 20*a*, and the above mentioned loading mechanism 73 for loading the paper strips introduced from the passage switching means 80 into the main entrance 66 of the third sorting stacker 65.

The passage switching means 80 has a mechanism for introducing the 1000 yen bank note having passed through the normal passage 20*a* of the main conveying unit 20 into the reversing passage 30*b* of the subsidiary conveying unit 30 in response to a signal from the face detecting means 52. Specifically, the passage switching means 80 has a switching plate 81 which is swung clockwise from the illustrated flat position to an erected position by 90 degrees when it receives a signal identifying "the face side up" from the face detecting means 52.

The switching plate 81 is swingably pivoted on the uppermost pulley 21 on which the vertical belt 25 is tensioned. The passage switching means 80 is substantially identical in structure with the guide mechanism 71.

The subsidiary conveying unit 30 is disposed so that it extends from the final terminal of the main conveying unit 20 along the outer periphery of the third sorting stacker 65 which is the uppermost in the stacking unit 60. The passage switching means 80 is positioned in between the main conveying unit 20 and the subsidiary conveying unit 30. The subsidiary conveying unit 30 has a reversing passage 30*b* in which 1000 yen bank notes introduced from the final terminal of the normal passage 20*a* by the passage switching means 80 are passed around the outer periphery of the third sorting stacker 65 and the paper strips of the bank notes are reversed.

The subsidiary conveying unit 30 extends upward along one end side of the third sorting stacker 65 from the final terminal of the main conveying unit 20 and curves at substantially right angle and extends along the upper side of the third sorting stacker 65 to the other end side of the third sorting stacker 65 and reaches a subsidiary entrance 67 provided on the other end side of the third sorting stacker 65.

Specifically, the subsidiary conveying unit 30 comprises a plurality of pulleys 31, an ascending belt 32 which is tensioned by respective pulleys 31, a horizontal belt 33, a descending belt 34 and pressing belt units 35 for pressing respective belts 32, 33 and 34. The spacings between the belts 32, 33, 34 and the pressing belt units 35 provide a reversing passage 30*b* through which 1000 yen bank notes pass.

A stationary guide plate 75 for guiding to the subsidiary entrance 67 of the third sorting stacker 65, 1000 yen bank notes which have passed through the reversing passage 30*b* is firmly secured in the vicinity of the lower end of the descending belt 34. A fourth deflecting means 70*d* for deflecting the 1000 yen bank notes into the third sorting stacker 65 from the subsidiary entrance 67 is provided so that it faces the subsidiary entrance 67.

The stacking unit 60 is provided with a paper strip lifting mechanism 90 in parallel with the unit 60. The paper lifting mechanism 90 comprises an elevating lever 91 which is driven in a vertical direction and plates 92 which extend to the inside of the sorting stackers 61, 63 and 65, firmly disposed to the elevating lever 91 substantially at right angles.

The paper strip lifting mechanism 90 is adapted to appropriately sort and stack again the paper strips stacked in the lower bins 61*b*, 63*b* and 65*b* of the sorting stackers 61, 63 and 65 into the upper bins 61*a*, 63*a* and 65*a*.

Now, operation will be described. In FIG. 1, a paper strip inserted into the receiving unit 12 of the paper strip conveying and stacking apparatus 10 from the paper strip conveying machine A is firstly conveyed to the separating mechanism 40, which is on the lower position of the frame 11, by the rotating introducing belt 22 of the main conveying unit 20. In the separating mechanism 40, the friction roller 41 is constantly rotated in a given direction, that is, counterclockwise as viewed in FIG. 1 while it is in contact with the one-by-one conveying belt 23 which is rotated by the electric motor (not shown).

If a strip of paper is conveyed to the lower side of the friction roller 41, the friction roller 41 would be lifted by one strip of paper. Since the spacing between the friction roller 41 and the reversing roller 42 is preset thicker than the thickness of one strip of paper, both rollers are not brought into contact with each other and the paper strip is conveyed toward the horizontal belt 24 by the one by one conveying belt 23.

If two or more stacked strips of paper are loaded, the friction roller 41 is brought into contact with the reversing roller 42 and is swung clockwise as shown in the drawing since the spacing between the friction roller 41 and the reversing roller 42 is thinner than the thickness of the two strips of paper. This causes the upper strip of paper which is in contact with the friction roller 41 to be returned upstream and only one strip of paper which is in contact with the one by one conveying belt 23 to be conveyed downstream. The paper strips which are delivered one by one by the separating machine 40 are conveyed horizontally through the normal passage 20*a* between the horizontal and pressing belts 24 and 26 and then conveyed vertically to the stacking unit 60 through the normal passage 20*a* extending vertically between the vertical belt 25 and the pressing belt unit 27.

When the paper strips are passed through the normal passage 20*a* along the vertical belt 25, various signals are output by the paper identifying unit 50 provided on a position along the length of the normal passage 20*a*. Identification of whether the paper strip passing through the normal passage one by one is a 1000 yen, 5000 yen or 1000 yen bank note is made by the sort detecting means 53. Identification of whether the 1000 yen bank note passes with the face side or the reverse side facing the face detecting means 52 provided on the inner side of the normal passage 20*a* is made by the detecting means. The number of the passing paper strips for each sort of the paper strip is output by the counting means 51.

In this case, if a signal identifying "10000 yen bank note" is output from the sort detecting means 53, the first deflecting means 70*a* is actuated in response to the signal for guiding the 10000 yen bank note passing through the normal passage 20*a* into the lower bin 61*b* of the first sorting stacker 61 from the main entrance 62.

Stated more specifically, the guide plate 72 of the guide mechanism 71 constituting the first deflecting means 70*a* is swung counterclockwise by 90 degrees from the illustrated erected position to the flat position for introducing the 10000 yen bank note to the main entrance 62 in response to the signal identifying "10000 yen bank note" from the sort detecting means 53. Subsequently, the 10000 yen bank note is loaded into the lower bin 61*b* of the first sorting stacker 61 via the main entrance 62 by means of the loading belt 74 of the loading mechanism 73.

Similarly, a 5000 yen bank note is loaded into the lower bin 63*b* of the second sorting stacker 63 via the main entrance 64 by the second deflecting means responsive to a signal from the sort detecting means 53.

When both a signal identifying "1000 yen bank note and a signal identifying "the face side up" are output from the sort detecting means 53 and the face detecting means 52, respectively, the third deflecting means 70*c* and the passage switching means 80 are actuated in response to these signals. In this case, the respective guide plates 72 of the guide mechanisms 71 for the first and second deflecting means 70*a* and 70*b* are in such an erected position that they do not block the normal passage 20*a*.

The switching plate 81 of the passage switching means 80 is swung to the illustrated laying position. This causes the 1000 yen bank note with its face side up to be loaded into the lower bin 65*b* of the third sorting stacker 65 via the main entrance 66 by the loading mechanism 73.

If the face detecting means 52 detects that the 1000 yen bank note passes through the normal passage 20*a* with the reverse side facing the face detecting means 52, the switching plate 81 of the passage switching means 80 is swung clockwise by 90 degrees from the illustrated laying position to the erected position in response to the signal from the face detecting means 52 for introducing the 1000 yen bank note from the final end of the main conveying unit 20 to the subsidiary conveying unit 30.

The 1000 yen bank note which is introduced to the reversing passage 30*b* of the subsidiary conveying unit 30 from the final end of the normal passage 20*a* is passed through the reversing passage 30*b* and is turned around the outer periphery of the third sorting stacker 65 and conveyed to the other end side of the stacking unit 60. This causes the 1000 yen bank note to be conveyed to the other end side of the third sorting stacker 65 with the face side up unlike the case where it is conveyed to the third sorting stacker 65 by the main conveying unit 20 and is then conveyed to the lower bin 65*b* of the third sorting stacker 65 from the subsidiary entrance by the fourth deflecting means 70*d*.

As mentioned above, the 1000 yen bank notes which are determined as "the face side up" by the face detecting means 52 are conveyed into the third sorting stacker 65 by means of the main conveying unit 20 without reversing the notes while the 1000 yen bank notes which are determined as "the reverse side up" by the face detecting means 52 are conveyed to the third sorting stacker 65 after reversing the sides by the subsidiary conveying unit 30. This causes all the 1000 yen bank notes loaded in the third sorting stacker 65 to be stacked with the face sides up.

The paper strips stacked in the lower bins 61*b*, 63*b* and 65*b* of the sorting stackers 61, 63 and 65 are appropriately arranged and stacked again in the upper bins 61*a*, 63*a* and 65*a*, respectively by the paper strip lifting mechanism 90.

Although the subsidiary conveying unit 30 is provided for only the third sorting stacker 65 so that only the 1000 yen bank notes are stacked with the face sides up, it is of course possible that the subsidiary conveying units 30 may be provided for the other or all of the sorting stackers.

If counting means is provided at the main and subsidiary entrances of each sorting stacker in addition to the counting means of the paper strip identifying unit for counting the paper strips, checking of the sorts and the number of the paper strips could be made so that fast trouble shooting is possible.

INDUSTRIAL APPLICABILITY

In accordance with the paper strip conveying and stacking apparatus of the present invention, the conveying unit for conveying paper strips to the stacking unit includes a main conveying unit having a normal passage through which the paper strips pass with either side up and a subsidiary conveying passage having a reversing passage for reversing the sides of the paper strips easily when they have passed therethrough. There are provided a means for detecting the faces of the paper strip at a position along the length of the normal passage, and a passage switching means for introducing the paper strips passing through the normal passage to said reversing passage in response to a signal from said face detecting means. Accordingly, the paper strips conveyed by the conveying unit can be sorted and stacked with the predetermined side up in the stacking unit by the simple structure. The stacked paper strips removed from the stacking unit are convenient for users since the predetermined sides of the paper strips face up.

If the stacking unit includes a plurality of sorting stackers each sorting and stacking the same sort of paper strips, which are arranged in a vertical direction and the conveying unit is additionally provided if needed, the paper strips of the same sort can be stacked with either side up in the corresponding sorting stacking unit.

What is claimed is:

1. A paper strip conveying and stacking apparatus including a receiving unit for receiving loaded paper strips and for discharging them, a conveying unit for conveying the paper strips discharged from said receiving unit and a stacking unit for sorting and stacking the conveyed paper strips therein, wherein: said stacking unit comprises: a lower bin for accepting the conveyed paper strips; an upper bin for accommodating and storing the conveyed paper strips accepted by said lower bin; and a lifting mechanism for lifting the paper strips from the lower bin to the upper bin; said lower bin having main and subsidiary entrances on one end and the other end sides, respectively; and said conveying unit comprises: a main conveying unit having a normal passage for conveying the paper strips received at the receiving unit to said main entrance; a subsidiary conveying unit having a reversing passage, said subsidiary conveying unit for passing the paper strips introduced from said normal passage around said stacking unit via said reversing passage to reverse the faces of the paper strips and to convey them to the subsidiary entrance; a first loading means for loading the paper strips from the normal passage into the stacking unit, introducing them through the main entrance into the lower bin of the stacking unit; a second loading means for loading the paper strips from the reversing passage into the stacking unit, introducing them through the subsidiary entrance into the lower bin of the stacking unit; face detecting means located at a position along the length of said normal passage for detecting the faces of the paper strips; and a passage switching means for introducing the paper strips passing through said normal passage to said reversing passage in response to a signal from said face detecting means, which is indicative of a result of the detection.

2. A paper strip conveying and stacking apparatus as defined in claim 1 in which the lower bin of said stacking unit holds the plurality of stacked paper strips and said lifting mechanism being adapted to lift the plurality of paper strips stacked in the lower bin up to the upper bin.

3. A paper strip conveying and stacking apparatus as defined in claim 1 in which there are provided a plurality of said stacking units which are arranged in a vertical direction.

4. A paper strip conveying and stacking apparatus as defined in claim 3 in which said receiving unit, conveying unit and stacking unit are disposed in the same housing.

5. A paper strip conveying and stacking apparatus as defined in claim 4 in which said stacking unit is disposed in the upper part of the housing and said receiving unit is disposed below the stacking unit.

6. A paper strip conveying and stacking apparatus as defined in claim 5 in which said normal passage is disposed along the side of the stacking unit at which the main entrances are provided from the lower part of the receiving unit toward the upper part of the stacking unit.

7. A paper strip convening and stacking apparatus as defined in claim 6 further including a separating mechanism disposed between said receiving unit and conveying unit for individually separating paper strips discharged from said receiving unit and for conveying them.

8. A paper strip conveying and stacking apparatus as defined in claim 7 further including counting means disposed at a position along the length of said normal passage for outputting the number of the paper strips passing through said normal passage.

9. A paper strip conveying and stacking apparatus including a receiving unit for receiving paper strips loaded thereinto and for discharging them therefrom, a conveying unit for conveying the paper strips discharged from said receiving unit and a stacking unit for sorting and stacking the conveyed paper strips therein, wherein:

said stacking unit comprises a plurality of sorting stackers for housing the paper strips and a lifting mechanism for transporting the paper strips from a lower side to an upper side in each of the sorting stackers;

said each sorting stacker being provided with a lower bin and an upper bin disposed in a vertical direction, said lower bin receiving the paper strips when conveyed by the conveying unit, and said upper bin stacking and storing the paper strips when the paper strips received in said lower bin are transported thereto by said lifting mechanism;

said lifting mechanism being provided at each of said sorting stackers, and having a plate extending transversely to the vertical direction of the each corresponding sorting stacker and a mechanism for lifting or lowering the plate between a lower position of said lower bin and a lower position of said upper bin throughout said lower bin in each of the respectively corresponding sorting stackers;

said conveying unit comprises:

a main conveying unit having a normal passage for conveying the paper strips received at the receiving unit to said lower bin of each of the sorting stackers;

a paper strip identifying unit disposed along a part of said main conveying unit and having a sort detecting unit for detecting the sort of the paper strips being conveyed to output a sorting signal; and a deflecting mechanism disposed at each of said sorting stackers, and operated in response to an identification signal output from said paper strip identifying unit for deflecting the conveyed paper strips from said normal passage into the lower bin of one of said sorting stackers.

10. A paper strip conveying and stacking apparatus as defined in claim 9, wherein said sorting stackers are arranged so as to be spaced in a vertical direction.

11. A paper strip conveying and stacking apparatus as defined in claim 10, wherein:

said paper strip identifying unit further comprises a counting means for detecting the number of the paper strips passing through said normal passage to output the signals indicating the number of the paper strips by sorts, by referring to the sorting signals of said sort detecting unit.

12. A paper strip conveying and stacking apparatus as defined in claim 11, wherein:

said conveying unit further comprises a subsidiary conveying unit for diverting the paper strips introduced from said normal passage to another passage around said stacking unit, said subsidiary conveying unit reversing the faces of the paper strips inside out or outside in and conveying the paper strips to the sorting stackers preliminarily determined respectively.

13. A paper strip conveying and stacking apparatus as defined in claim 12, wherein:

said paper strip identifying unit further comprises face detecting means for detecting the face of the paper strips and for generating face signals; and said conveying unit comprises passage switching means which is disposed at a switching point between said subsidiary conveying unit and said normal passage for diverting the paper strips passing through said normal passage to said another passage for face reversing in response to the face signals generated by said face detecting means.

14. A paper strip conveying and stacking apparatus as defined in claim 13, wherein:

said receiving unit, conveying unit and stacking unit are disposed in the same housing, said stacking unit being disposed at an upper portion of the housing and said receiving unit being disposed at a lower portion of the stacking unit.

15. A paper strip conveying and stacking apparatus as defined in claim 14, further comprising a separating mechanism disposed between said receiving unit and said conveying unit for separating the paper strips discharged from said receiving unit one by one.

* * * * *